US008397951B2

(12) United States Patent
Moretti

(10) Patent No.: US 8,397,951 B2
(45) Date of Patent: Mar. 19, 2013

(54) DEVICE FOR CONTAINING FLUID SUBSTANCES UNDER AIRTIGHT CONDITIONS AND FOR DISPENSING THEM

(75) Inventor: Matteo Moretti, Crema (IT)

(73) Assignee: Lumson S.p.A., Capergnanica (IT)

( * ) Notice: Subject to any disclaimer, the term of this patent is extended or adjusted under 35 U.S.C. 154(b) by 438 days.

(21) Appl. No.: 12/753,595

(22) Filed: Apr. 2, 2010

(65) Prior Publication Data

US 2010/0264166 A1 Oct. 21, 2010

(30) Foreign Application Priority Data

Apr. 20, 2009 (IT) ..... MI2009A0649

(51) Int. Cl.

| | |
|---|---|
| ***B65D 35/56*** | (2006.01) |
| ***B65D 35/28*** | (2006.01) |
| ***B65D 88/54*** | (2006.01) |
| ***B67D 7/60*** | (2010.01) |

(52) U.S. Cl. ..... 222/105; 222/95; 222/386.5; 222/321.9

(58) Field of Classification Search ..... 222/105, 222/386.5, 95, 383.1, 321.1, 321.7–321.9
See application file for complete search history.

(56) References Cited

U.S. PATENT DOCUMENTS

| | | | | |
|---|---|---|---|---|
| 3,791,557 | A * | 2/1974 | Venus, Jr. | 222/105 |
| 4,892,232 | A * | 1/1990 | Martin | 222/207 |
| 4,955,512 | A * | 9/1990 | Sharples | 222/386.5 |
| 5,004,123 | A * | 4/1991 | Stoody | 222/94 |
| 5,183,185 | A * | 2/1993 | Hutcheson et al. | 222/209 |
| 5,630,531 | A * | 5/1997 | Gaucher | 222/96 |
| 5,772,079 | A * | 6/1998 | Gueret | 222/321.7 |
| 6,505,986 | B1 * | 1/2003 | Oder | 401/183 |
| 6,578,738 | B1 * | 6/2003 | Keller | 222/83 |
| 6,666,355 | B2 * | 12/2003 | Padar | 222/152 |
| 7,086,570 | B2 * | 8/2006 | Canegallo | 222/386.5 |
| 2005/0082315 | A1 * | 4/2005 | Hayakawa et al. | 222/192 |
| 2010/0044393 | A1 | 2/2010 | Moretti | |
| 2010/0059545 | A1 * | 3/2010 | Moore et al. | 222/105 |
| 2011/0095053 | A1 * | 4/2011 | Greiner-Perth et al. | 222/105 |

FOREIGN PATENT DOCUMENTS

EP 1 433 534 A2 6/2004

OTHER PUBLICATIONS

U.S. Appl. No. 12/762,700, filed Apr. 19, 2010, Moretti.

* cited by examiner

*Primary Examiner* — Kevin P Shaver
*Assistant Examiner* — Nicolas Weiss
(74) *Attorney, Agent, or Firm* — Oblon, Spivak, McClelland, Maier & Neustadt, L.L.P.

(57) ABSTRACT

A device for containing fluid substances under airtight conditions and dispensing them, comprising a rigid container (5) in which a bag (9) made of thermoplastic material is inserted having a flange (3, 3A) and a hole for housing the body of a (P), the body of the pump (P) being pressed to form a seal on said flange (3, 3A) of the bag (9) by a first ring cap (N), a second ring cap (G) being screwed onto the container neck (6) and secured to the bag (9), the first ring cap (N) being locked to the second ring cap (G), engagement means (13, 14) being provided between said first and second ring cap to make said first and second ring cap torsionally rigid with each other such that a rotation imposed on the first ring cap (N) of the pump results in a corresponding rotation of the second ring cap (G), hence facilitating extraction of the bag from the container consequent on the removal of the pump (P) from the container (5).

14 Claims, 8 Drawing Sheets

DEVICE FOR CONTAINING FLUID SUBSTANCES UNDER AIRTIGHT CONDITIONS AND FOR DISPENSING THEM

The present invention relates to a device for dispensing, by means of a manually operable pump, fluid substances contained under airtight conditions in a deformable bag housed in a rigid container.

More particularly, it relates to a device in which the bag is extracted from the container simultaneously with the removal of the pump from the container neck.

It is known to enclose fluid substances (both liquid and creamy) in containers from which these substances are dispensed by manually operating a small pump mounted on the mouth of a respective container. Pump operation causes a quantity of fluid substance to be withdrawn from the container in which—if the container is rigid—a vacuum forms which would prevent further substance withdrawal and dispensing if air were not allowed to enter the container (which generally takes place in those regions in which the pump makes contact with and slides on the pump body), or if the container did not comprise a base sealedly movable along an internal cylindrical surface of the container (see for example U.S. Pat. No. 4,691,847, U.S. Pat. No. 4,694,977 and U.S. Pat. No. 5,971,224): this latter system for compensating the container internal volume by reducing its internal volume while maintaining the internal pressure constant is however very laborious and costly.

In many cases it is opportune or necessary that the fluid substance to be dispensed by a pump never comes into contact with the atmosphere inside the container (with the dispensing pump mounted on it): sealing the fluid out of contact with the atmosphere is important if the composition of the fluid within the container is not to undergo alteration, or if it is essential that the fluid substance enclosed in the container remains sterile. To achieve this, U.S. Pat. No. 3,288,334 describes a device comprising a pump mounted on a container bounded by deformable walls which gradually collapse (to hence diminish the container internal volume) as the pump dispenses portions of fluid substance by withdrawing it from the container. A more functional embodiment is described in U.S. Pat. No. 5,273,191 which proposes a device comprising a bag of elastically deformable material containing the substance which has to remain isolated from the atmosphere in the bag, and having a mouth which is sealedly closed by a dispensing head consisting of a valve, the bag being housed in an elastically deformable protection container containing a liquid: when the user manually compresses the deformable container, the pressure of the liquid present in the space between the container and the bag increases, to hence pressurize the fluid substance sealed in the bag and finally cause the fluid substance to be dispensed by the said dispensing head (following the manual compression exerted on the external container). More specifically (see column 4, lines 22-28) the bag is made of elastically deformable flexible material and has a neck on which a support element (having a profiled aperture for housing a pump) is sealedly applied after the bag has been filled with the fluid substance to be dispensed: after this, a pump is sealedly mounted on said support element to hence prevent contamination of the fluid substance by the air (column 5, lines 15-38). The bag containing the fluid substance and having the pump sealedly mounted on its neck is then inserted into a rigid container (obviously being very careful that the free end of the rigid container does not come into contact with the bag filled with fluid substance, in order not to break it) on which said support element is then positioned and fixed (column 5, lines 56-61). Hence between the outer surface of the bag and the inner surface of the rigid container an interspace is formed which is connected to atmosphere via a hole provided in the container base; in this manner, when the fluid substance is withdrawn from the bag by operating the pump, the bag is squeezed by the atmospheric pressure so that it can be easily withdrawn and expelled to the outside by the pump (column 5, lines 70-73). The main drawback of the aforesaid device is that the deformable bag must be filled with fluid substance before the bag is inserted into the respective rigid container and that the operation involved in inserting the bag into the container is very delicate because the bag can be easily torn while being inserted into the container interior.

JP 05 031790A and JP 05 031791A published on Sep. 2, 1993 describe how a bag of elastically deformable material can be produced directly within a rigid container. For this purpose an elongated preform (made of thermoplastic material and having an elongated hollow cylindrical body, open at one end where the preform presents a neck from which a flange radially projects) is inserted into a rigid container having a mouth from which a neck extends, on the free edge of which there rests the flange of the preform, which is heated and then inflated within the container, until a bag forms, the outer surface of which adheres (at least for a large part of its surface) to the inner surface of the container. The bag obtained in this manner also has a neck, at least an end portion of which presents outwardly projecting longitudinal ribs, with some radial ribs or projections projecting from that surface of the preform flange which faces the free edge of the neck of the container in which the bag is inserted: these ribs or projections define passages for the air which penetrates from the outside between the container and bag to enable this latter to flatten or inwardly deform during outward dispensing of the fluid substance through the pump, so preventing the formation inside the bag of a vacuum which would prevent dispensing of the fluid substance.

US 2004/0112921A1 published on 17.06.2004 (in the name of the same applicant as the two aforestated Japanese patent applications) illustrates a device comprising a container and a deformable bag such as that of the two Japanese patent applications, and in which a manually operable pump is mounted by means of a ring cap having a thread which engages and screws onto a corresponding screw thread projecting from the surface of the container neck. The pump is maintained pressed by the ring cap (screwed onto the container neck) to seal against the flange projecting from the bag mouth, passages being provided enabling air to pass from the outside to the space between the bag and container to enable the bag to gradually shrink onto itself as the quantity of fluid substance dispensed by the pump increases. Devices totally similar (and hence not requiring further comment) to that of US2004/011292A1 are described in DE 770772 U1 and NL 1 021 710 C2.

In all these devices, when (on termination of fluid substance dispensing from the respective bags) the ring cap retaining the pump on the neck of the deformable bag is unscrewed from the spiral rib of the neck of the respective container and the pump is removed, the deformable bag remains retained inside the container. This constitutes a problem because national laws regarding environmental protection require the deformable to bag (made of thermoplastic material or the like) to be disposed of separately from the container (which can be of glass or other rigid material suitable for the purpose). In the known devices described in the aforestated prior patents, it is not however possible to easily extract the deformable bag from the container, when fluid substance dispensing has terminated.

The main object of the present invention is therefore to provide a device of the stated type in which the respective deformable bag remains securely and automatically connected to the dispensing pump when the pump is coupled to the container neck, to hence cause the bag to be extracted from the container at the same moment as that in which the pump is removed from the container.

As the device described herein is preferably usable to contain and dispense valuable products (such as perfumes, creams, deodorant substances, medical substances and the like) for which glass containers are used, it becomes very easy to separate the glass container from the plastic bag, to achieve optimal refuse sorting.

These and other objects are attained by a device in accordance with the technical teachings of the accompanying claims.

Further characteristics and advantages of the invention will be apparent from the description of a preferred but non-exclusive embodiment of the device, illustrated by way of non-limiting example in the accompanying drawings, in which.

Figure 1:
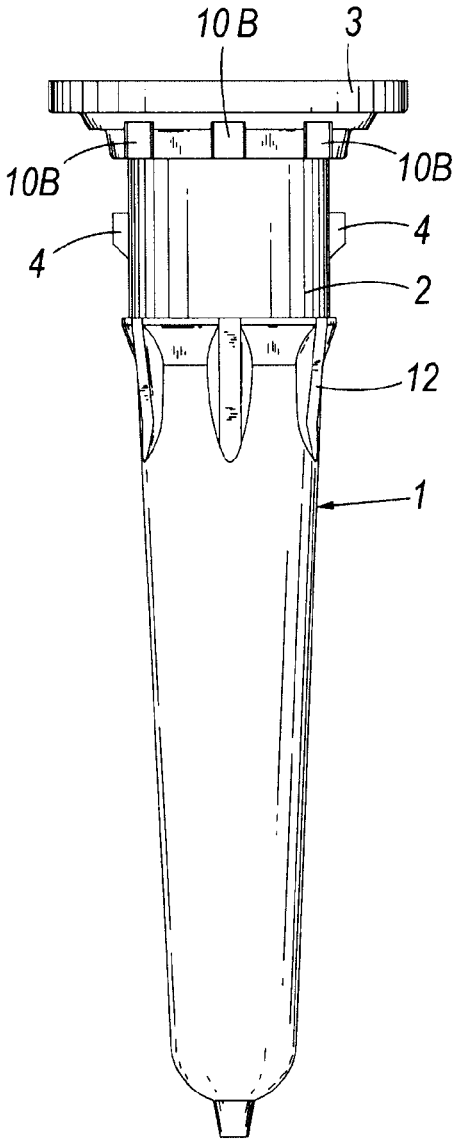
FIG. 1 is a side elevation of a hollow preform intended to form the bag for containing a fluid substance.
Figure 3:
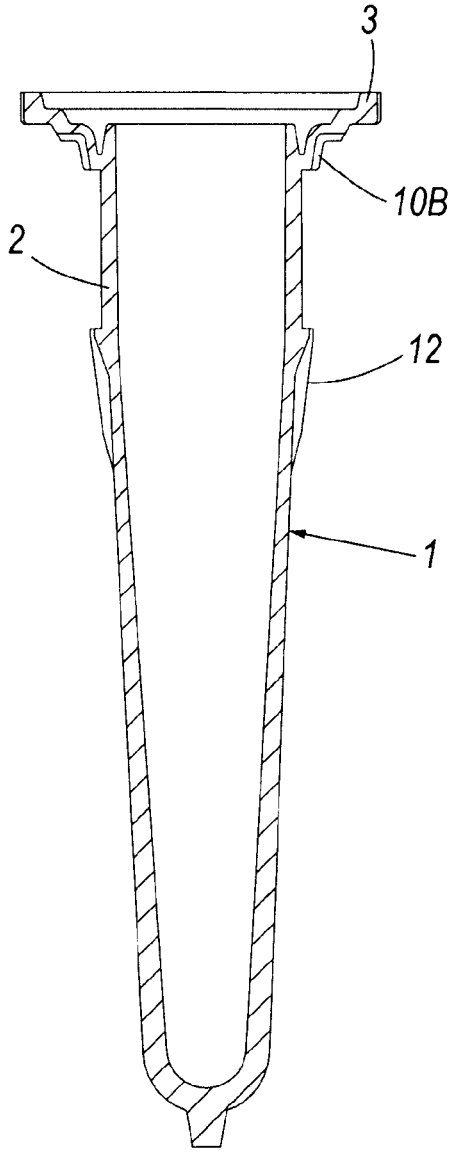
FIG. 3 is a longitudinal section through the preform of FIG. 1.
Figure 2:
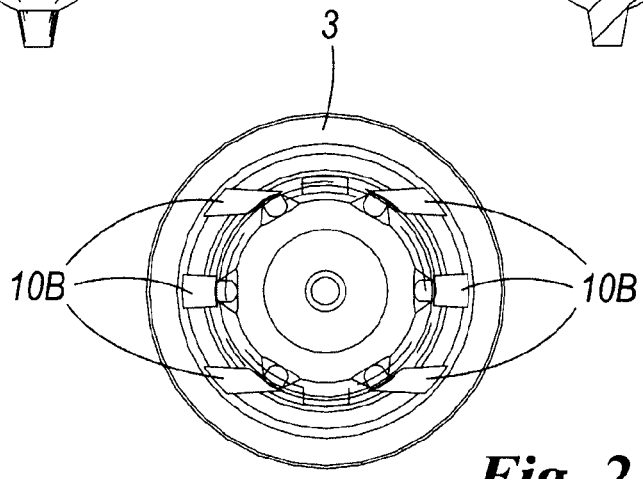
FIG. 2 is a view of the preform of FIG. 1, seen from below.

Reference will firstly be made to FIG. 1 which represents a side elevation of an internally hollow elongated preform (obtained by injection and blow moulding in a mould by methods well known in the art) made of thermoplastic material (such as polyethylene, pet, polypropylene) and having an elongated hollow cylindrical body 1 open at one end at which the preform presents a profiled neck 2 from which a flange 3 radially projects with non-uniform thickness. Spaced-apart teeth or thin longitudinal ribs 4 project from the outer surface of the neck 2.

The transverse dimensions of the body 1 are such that it can be freely inserted into the rigid body 5 (advantageously made of glass), the neck 2 of the preform being of such a shape and dimensions as to be easily penetrable into the hole in the neck 6 of the body 5, with the free ends of the teeth 4 being substantially in contact with the inner surface of the hole in the neck 6.

When the preform is inserted into the container 5, the flange 3 rests particularly on a step 16 provided in a first ring cap G screwed onto the container neck.

Hence the projecting flange 3 of the preform does not rest directly on the end of the neck 6 but only on the step 16 but without sealedly adhering to it. In this respect, spaced-apart cut-outs 10B are present on the lower surface (with reference to FIG. 1) of the flange 3.

In his manner free passages 7 form between the flange 3 of the preform neck and the step of the ring cap, while other free passages 8 form (between each tooth 4 and the tooth adjacent to it) between the outer surface of the preform neck 2 and the inner surface of the hole in the neck 6 of the rigid container 5.

Further air passages are provided by the threaded coupling between the exterior of the container neck and the interior of the second ring cap N. Hence essentially, the interspace between the inner surface of the container 5 and the exterior of the preform (which when heated and inflated forms the bag 9) is in free communication with the outside and is therefore at atmospheric pressure.

Figure 6:
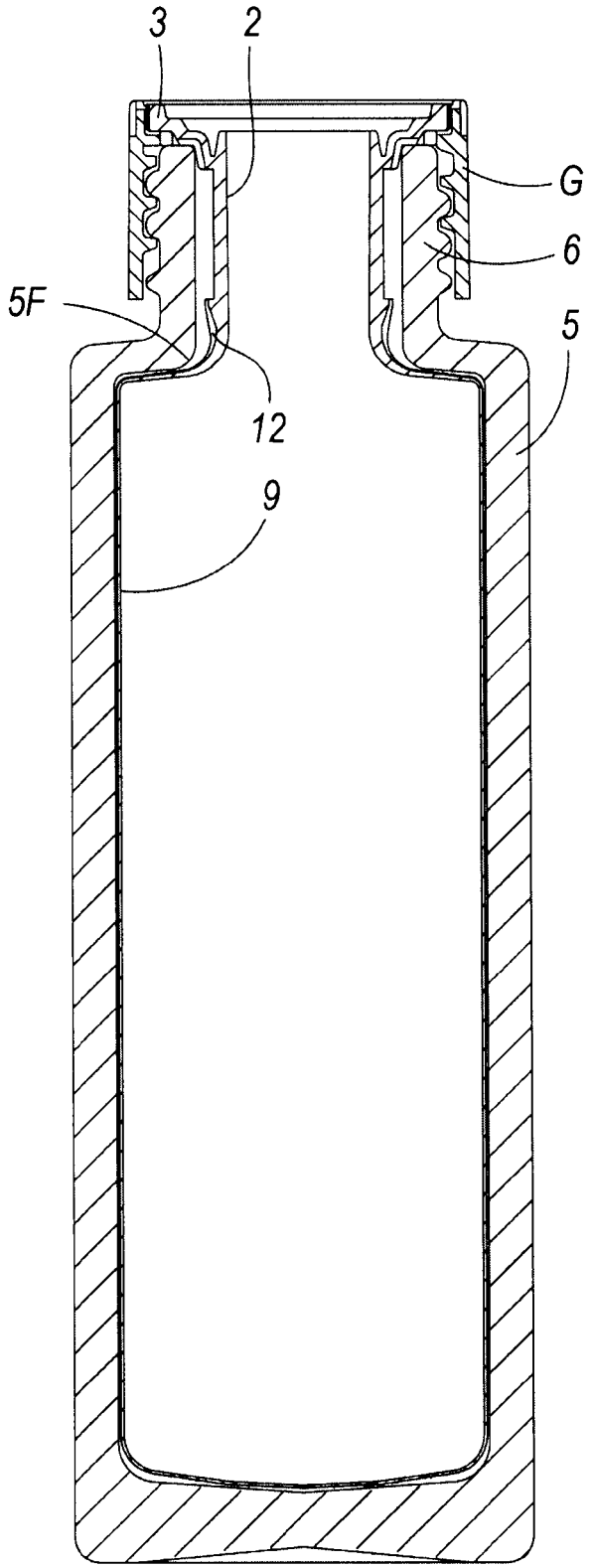
FIG. 6 is a view of FIG. 5 after the preform has been deformed by heating and inflating, to hence form a bag inside the container.

The hot preform is inserted into the container, and air (or another gas or a liquid) is fed—as described in JP 05 031790A and JP 05 031791A the teachings of which are incorporated herein—into the preform, which is hence deformed to inflate and lengthen as shown in FIG. 6 until it rests on the inner surface of the cavity of the rigid container 5 to form a widened bag indicated by the numeral 9. In this manner the preform (now a bag) and the container form a rigid body which can be easily transported (without danger of undergoing damage) from its place of production to that of its utilization or filling: the thickness of the wall of the bag 9 can be for example about 0.1-0.4 mm.

Advantageously, as easily seen in FIG. 1, the bag or preform presents a series of ribs 12 on a portion which, when inflated to form the bag, lies substantially in contact with a connection corner 5F between the neck and body of the container 5. The presence of these ribs 12 hence contributes to avoiding complete adherence of this portion to the inner surface of the container precisely at this connection corner. Thus after inflation further air passages are available, being very useful for emptying the bag.

The user receiving the container 5 with the bag 9 already inserted and retained in it introduces into the bag (through the aperture in its neck 2) the desired quantity of fluid substance F (FIG. 7), which can fill the bag as far as its neck 2. The said user then inserts into the bag 9, through the aperture in its neck, a manually operable pump P having a dispensing stem S (which projects to the outside of the bag 9 and of the container 5) and a dip tube U which is immersed in the fluid substance contained in the bag.

Figure 7:
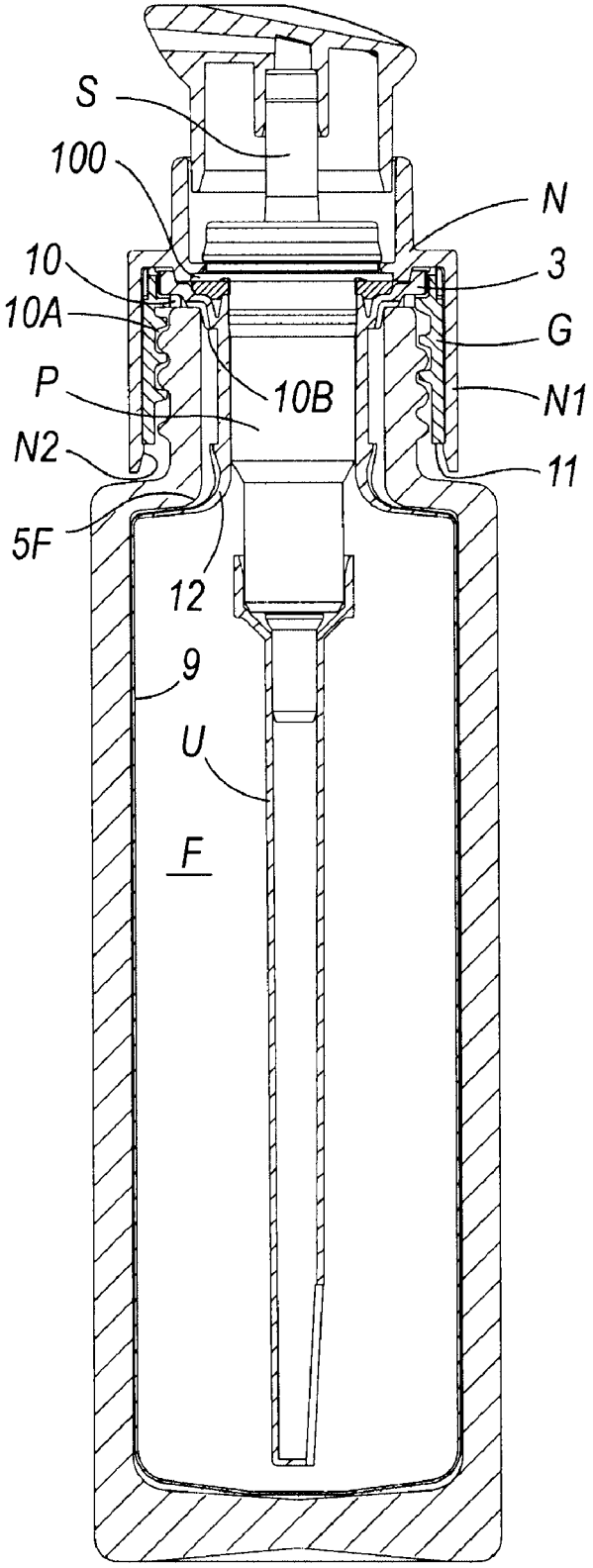
FIG. 7 is a longitudinal section through the device, complete with dispensing pump locked onto the first ring cap, and with its fluid substance enclosed airtight in the bag.

The pump P is then locked securely onto the neck 6 of the container by the second ring cap N mounted on the outer surface of the first ring cap G (see FIG. 7). The second ring cap N has a cylindrical surface N1 presenting on its base a projecting rim N2 which securely engages (preferably via an undercut) the lower edge 11 of the first ring cap G to form a locking part. Advantageously a cylindrically extending element (preferably of metal) is disposed above the second ring cap N to prevent disengagement between the first and second ring cap N, G, on pressing the cylindrical part N1.

Figure 10:
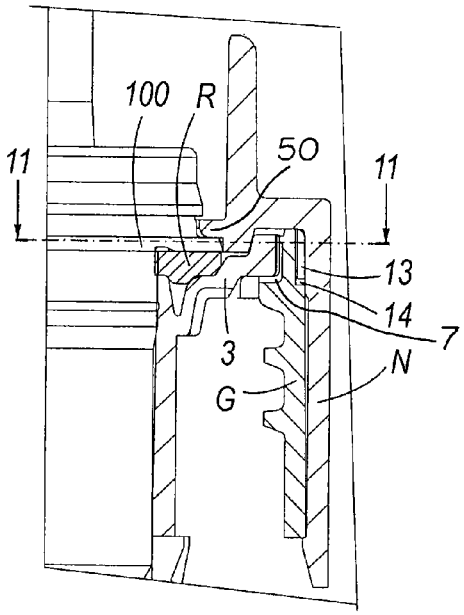
FIG. 10 shows a detail of the region in which the bag is fixed to the ring cap and pump.

The second ring cap N has a pressing part 50 that rests on the upper surface of a collar 100 which projects radially from the body of the pump P and presses it into sealed contact with a flange 3 of the neck 2 of the bag 9, hence pressing the lower part of the pump 6 into the cavity of the bag collar 2 to form a seal, as can be seen from FIG. 10, this seal being further improved by an elastic ring R positioned immediately below the collar 10.

Essentially, both the pump and bag are sandwich-compressed between the first and second ring cap G and N, and remain perfectly engaged thereby to form a single body.

It should be noted that engagement (rotational locking) means 13, 14, 16 are provided in a coupling region between the first and second ring cap to make the first ring cap rotate together with the second ring cap. In the illustrated embodiment these means comprise a pair of undulated profiles 160 correspondingly provided both on the outside of the first ring cap and on the inside of the second. These profiles comprise at least one tooth 13 for engagement with a corresponding groove 14.

Figure 11:
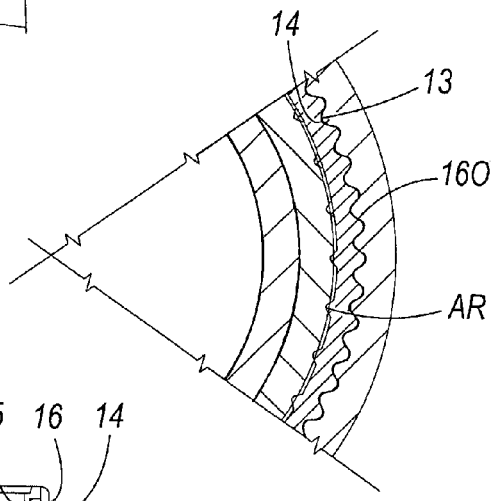
FIG. 11 is a partial section taken on the line 11-11 of FIG. 10.
Figure 4:
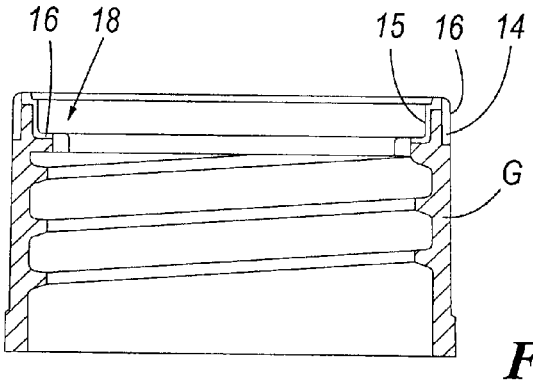
FIG. 4 is a longitudinal section through a ring cap on which the hollow preform rests when positioned on a container.
Figure 5:
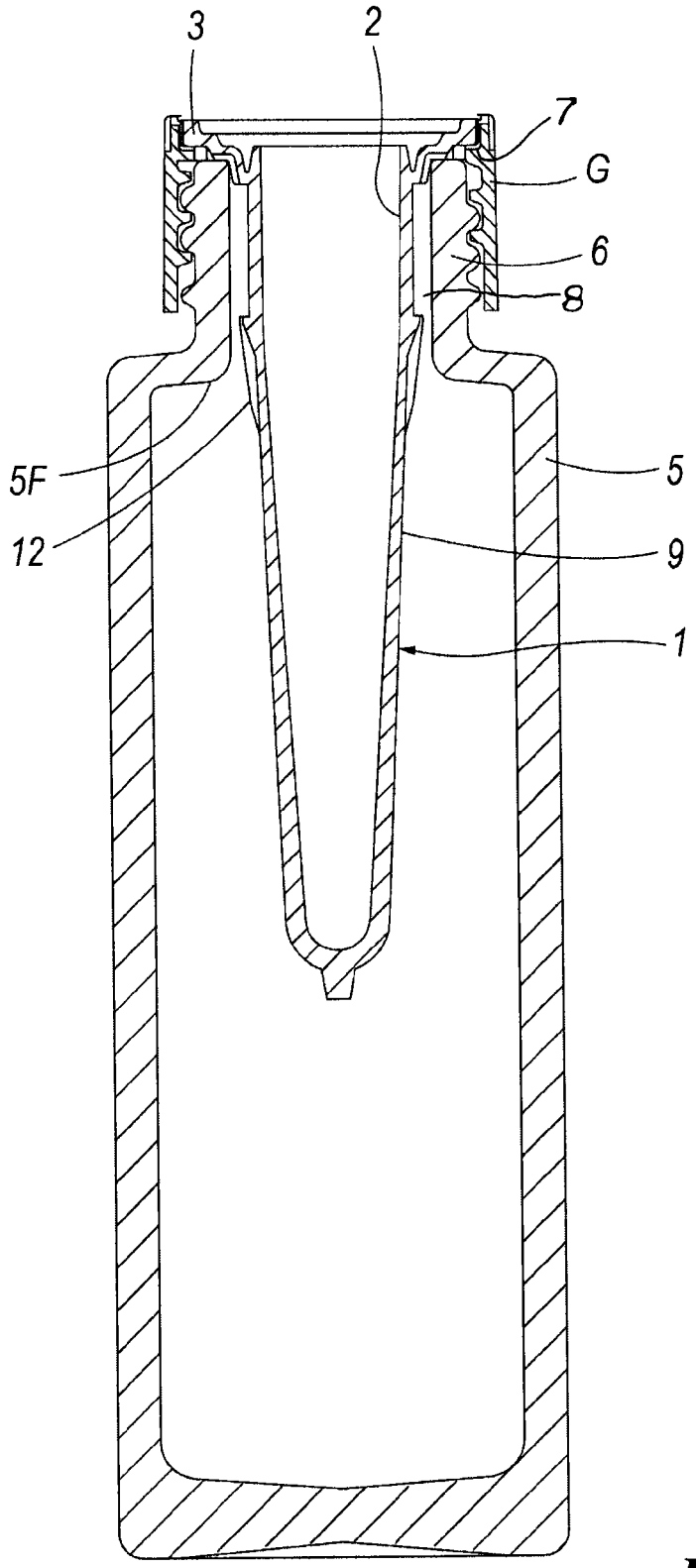
FIG. 5 is a section through the container after the ring cap of FIG. 4 has been screwed onto the container neck and the preform of FIG. 1 has been inserted into its interior.

In the illustrated embodiment the flange 3 has a continuous peripheral edge (as can be seen from FIG. 11); in this case the first ring cap G is formed such that from its most inner surface at the step 16 there projects a succession of projections or deformable rib portions (or alternatively a single rib) defining a recess (or annular groove 18 at the base of which the step is present) in which the free edge of the flange 3 projecting from the bag neck is inserted and retained.

This facilitates the operations immediately following the insertion of the preform into the container in that the preform, not yet transformed into a bag, remains secured to the first ring cap G.

The use of the device is apparent from the aforegoing and is substantially as follows.

Dispensing the product F causes the bag 9 to squash towards the dip tube. In this respect, the pump and the pump/bag coupling do not enable air to enter the bag interior during dispensing. When the product F to be dispensed is totally used (such a condition being that of FIG. 8, with the bag 9 close to the dip tube U), the container 5 has to be separated from the pump/ring cap/bag assembly.

Figure 8:
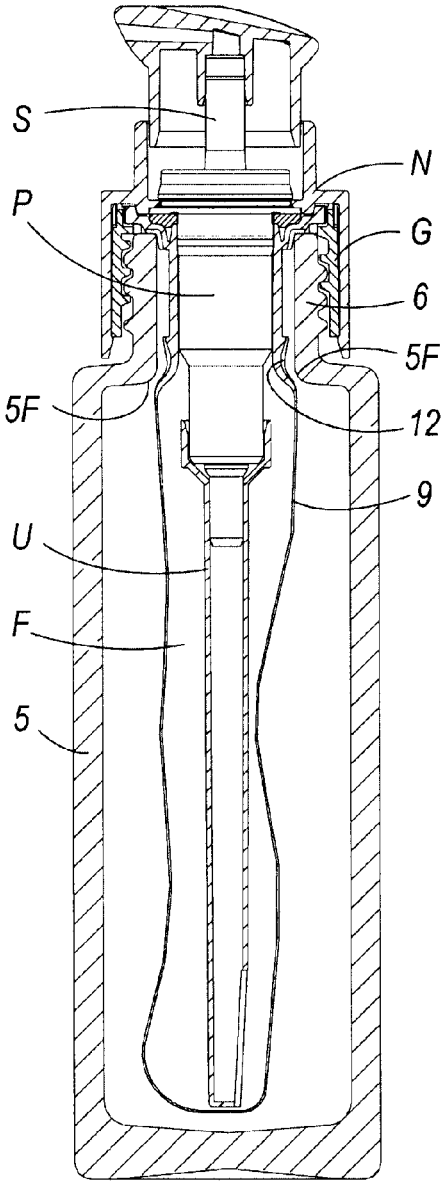
FIG. 8 shows the device of FIG. 7 when the product in the bag is nearly depleted and the pump and bag are to be separated from the container.
Figure 9:
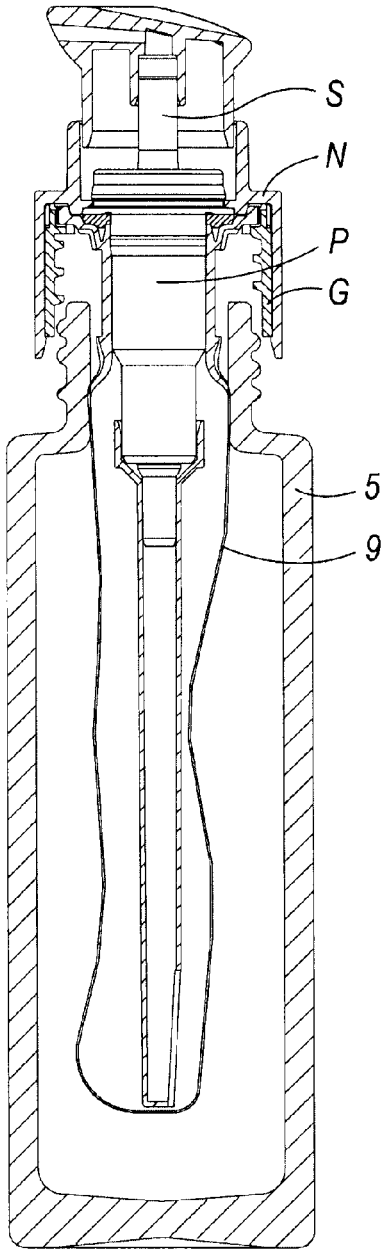
FIG. 9 shows in axial section a first step in the separation of the pump and bag from the container, following a rotation of the pump ring cap.
Figure 12:
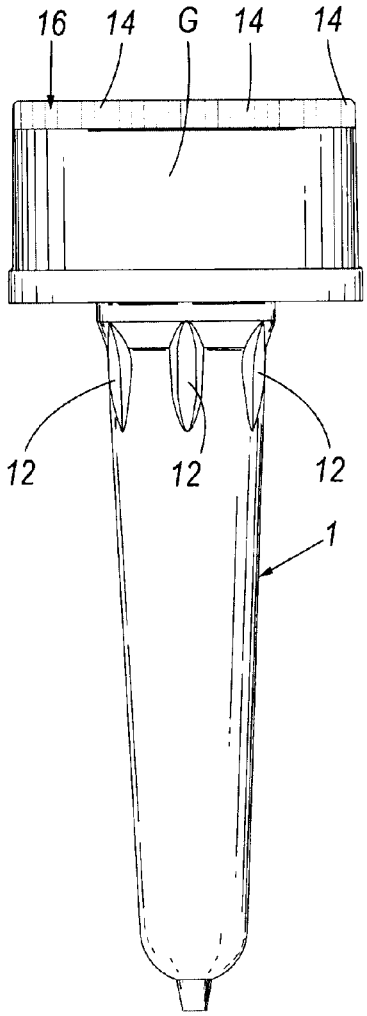
FIG. 12 shows a different embodiment of the preform of FIG. 1 which forms the bag when inflated.
Figure 14:
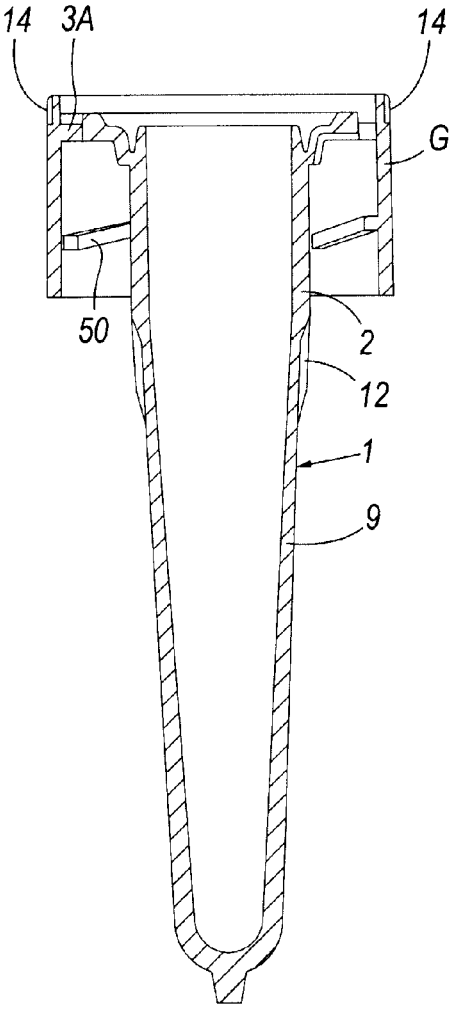
FIG. 14 is a longitudinal section through the preform of FIG. 12.
Figure 13:
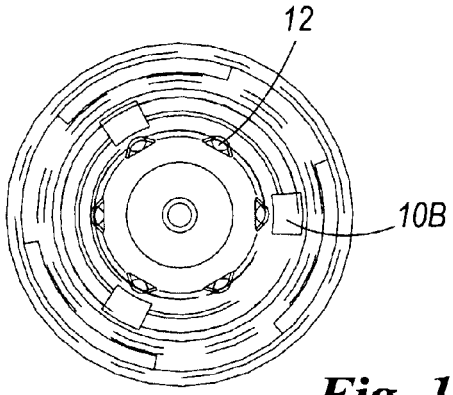
FIG. 13 is a view of the preform of FIG. 12 taken from below.
Figure 15:
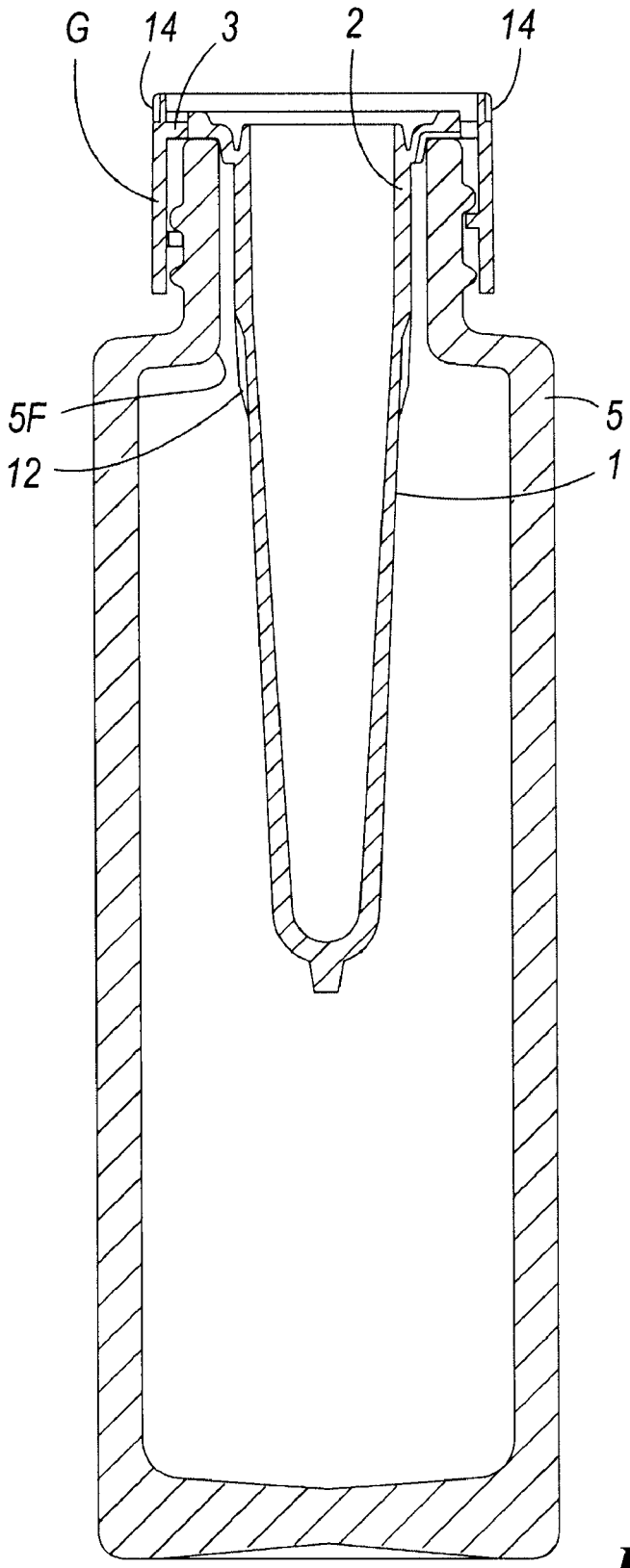
FIG. 15 is a section through the container after the portion of FIG. 12 has been screwed onto the container neck.

It should be noted that in FIGS. 8 and 9 the bag does not completely rest against the dip tube, and there is still a large amount of product between the dispensing pump and bag. However the description to be given is by way of example only, it being of no importance if not all the available product has been consumed.

By rotating the second pump ring cap N the ring cap G is also made to rotate (by virtue of the means 16). The bag, clamped between the first and second ring cap, is then raised forcibly (deriving from the threaded coupling) and at least partially extracted from the container 5.

The pump P is then removed from the container 5 to completely extract the bag therefrom.

Advantageously the bag is clamped to the first (and to the second) ring cap very securely by the flange 3, which is fixed to the first ring cap G by the second ring cap N of the pump.

It should be noted that especially to extract the first part of the bag 9 from the container a strong traction force has to be applied to it (even if there is less product F than that present under the conditions of FIGS. 8 and 9).

The presence of the thread (or the like, e.g. a bayonet connection) enables a considerable extraction force to be exerted on the bag 9. The flange 3, perfectly secured to the first ring cap G by the second ring cap N, is able to transmit this traction force to the bag, which is easily released from the container 5 (at least in a first step).

Removing the pump P from the container 5 then enables the bag to be completely extracted (without effort) from this latter, and enables the plastic material with which the pump ring cap and bag are formed to be disposed of separately from the valuable material, for example glass, with which the container may be formed. This container could also be reused.

As stated with reference to the figures, it can be noted that the threads projecting inwards from the first ring cap G engage the threads projecting from the container neck, but without sealing against them, hence leaving a free passage 10A enabling the external atmosphere to communicate via the passages defined by the ribs 4 and 10B with the interspace between the inner surface of the container 5 and the outer surface of the bag 9 housed therein.

The container can evidently be made of any rigid material (in addition to glass), for example aluminium or other metal: in any event it is not strictly necessary that the air which is to penetrate into the space between the bag and the container passes or seeps between the threads of the ring cap and container neck and then through the passages which have been described with reference to the figures: this is because one or more air passage holes can be provided in the container for air passage, as illustrated in U.S. Pat. No. 3,420,413 and US 2004/0112921 A1.

In an alternative embodiment, shown in Figures from 12 to 15, the preform and the ring cap G (which present all the aforedescribed characteristics) are formed as one piece, of the same material, which can be any one of the aforedescribed.

The ring cap and preform (bag) are connected together at the flange 3, to form a single piece as stated.

Consequently the preform and the first ring cap G are no longer clamped by the second ring cap N, but are locked together by virtue of being formed in one piece.

All the characteristics already described for the first embodiment, in particular for the ring cap G and the bag 9, are substantially identical for the second embodiment. Consequently the previously described characteristics, which are immediately apparent on analyzing the accompanying drawings, will not be repeated.

It should be noted only that in this embodiment, the thread 50 provided on the inside of the first ring cap G is formed from discontinuous helical ribs, instead of from a continuous thread. This evidently does not involve any substantial operating difference compared with the preceding embodiment.

The invention claimed is:

1. A device for containing and dispensing fluid substances, comprising:

a rigid container having a container neck defining an aperture which provides access to a cavity of the container, wherein the container neck has an external threading;

a thermoplastic bag housed in the rigid container while providing an interspace between the bag and an inside surface of the rigid container, the bag having a neck defining a hole to provide access to a cavity of the bag, the neck of the bag further having a radial flange;

a manually operable pump including a tube extending into the bag, for withdrawing a fluid substance from the bag;

a first ring cap screwed onto the external threading of the container neck;

the second ring cap has a pressing part that presses the pump to the radial flange to form a seal between the pump and the bag, and to secure the bag to the first ring cap and the second ring cap, by the second ring cap being locked to the first ring cap;

rotational locking means for rotationally locking the second ring cap to the first ring cap; and at least one air passage providing air communication between the interspace and the exterior of the rigid container.

2. The device as claimed in claim 1, wherein the rotational locking means comprises at least one tooth provided at one of the first ring cap and the second ring cap, and at least one seat, cooperating with the at least one tooth, and provided at the other of the first ring cap and the second ring cap.

3. The device as claimed in claim 1, wherein the rotational locking means is formed from a pair of corresponding undulated profiles.

4. The device as claimed in claim 1, wherein the locking part comprises:

an undercut at a lower portion of the first ring cap; and a projecting rim at a lower portion of the second ring cap and able to engage the undercut of the first ring cap.

5. The device as claimed in claim 1, wherein the bag presents a series of ribs on a portion thereof corresponding to a connection corner between the container neck and a body of the container.

6. The device as claimed in claim 1, wherein the air passages includes passages provided between the first ring cap and the container neck, and between the radial flange and the container neck.

7. The device as claimed in claim 6, wherein the passages between the radial flange and the container neck comprise cutouts provided on the radial flange, which cutouts at least partially involve a contact surface between the radial flange and a mouth of the container.

8. A device for containing and dispensing fluid substances, comprising:

a rigid container having a container neck defining an aperture which provides access to a cavity of the container, wherein the container neck has an external threading;

a thermoplastic bag housed in the rigid container while providing an interspace between the bag and an inside surface of the rigid container, the bag having a neck defining a hole to provide access to a cavity of the bag, the neck of the bag further having a radial flange;

a manually operable pump including a tube extending into the bag, for withdrawing a fluid substance from the bag;

a first ring cap formed unitarily with the bag and screwed onto the external threading of the container neck;

a second ring cap locked to the first ring cap by a locking part, wherein the second ring cap has a pressing part that presses the pump to the radial flange to form a seal between the pump and the bag by the second ring cap being locked to the first ring cap;

rotational locking means for rotationally locking the second ring cap to the first ring cap; and at least one air passage providing air communication between the interspace and the exterior of the rigid container.

9. The device as claimed in claim 8, wherein the rotational locking means comprises at least one tooth provided at one of the first ring cap and the second ring cap, and at least one seat, cooperating with the at least one tooth, and provided at the other of the first ring cap and the second ring cap.

10. The device as claimed in claim 8, wherein the rotational locking means is formed from a pair of corresponding undulated profiles.

11. The device as claimed in claim 8, wherein the locking part comprises:

an undercut at a lower portion of the first ring cap; and a projecting rim at a lower portion of the second ring cap and able to engage the undercut of the first ring cap.

12. The device as claimed in claim 8, wherein the bag presents a series of ribs on a portion thereof corresponding to a connection corner between the container neck and a body of the container.

13. The device as claimed in claim 8, wherein the air passages includes passages provided between the first ring cap and the container neck, and between the radial flange and the container neck.

14. The device as claimed in claim 13, wherein the passages between the radial flange and the container neck comprise cutouts provided on the radial flange, which cutouts at least partially involve a contact surface between the radial flange and the container mouth.

* * * * *